United States Patent [19]

Deaver et al.

[11] 4,406,098

[45] Sep. 27, 1983

[54] DRILLING RAMP

[75] Inventors: Pete E. Deaver, Midland; Jerry K. Lingafelter, Wichita Falls, both of Tex.; Odis F. Hamill, Durant, Okla.

[73] Assignee: Walker-Neer Manufacturing Co., Inc., Wichita Falls, Tex.

[21] Appl. No.: 329,703

[22] Filed: Dec. 11, 1981

[51] Int. Cl.[3] ..... B66C 23/36; E01F 11/00

[52] U.S. Cl. ..... 52/119; 410/56; 410/65; 414/401

[58] Field of Search ..... 52/111, 116, 119, 174; 410/30, 56, 65, 66, 67; 414/396, 401

[56] References Cited

U.S. PATENT DOCUMENTS

| | | | |
|---|---|---|---|
| 1,780,277 | 11/1930 | Seeley et al. | 410/30 |
| 3,307,722 | 3/1967 | Godille | 410/65 |
| 3,437,056 | 4/1969 | O'Leary | 410/65 |
| 3,543,693 | 12/1970 | Thornton et al. | 410/65 |

*Primary Examiner*—John E. Murtagh
*Assistant Examiner*—Richard E. Chilcot, Jr.
*Attorney, Agent, or Firm*—Hume, Clement, Brinks, Willian & Olds, Ltd.

[57] ABSTRACT

A drilling ramp for a mobile drilling rig of the type having a wheeled vehicle and a mast substructure, wherein the substructure includes four legs, two of which serve to mount power hydraulic jacks and two of which serve to mount leg locating sockets. The ramp includes a substantially planar foundation structure adapted to support the drilling rig. Longitudinal guide bars and transverse chocks are mounted on the foundation structure to guide and position wheels of the drilling rig. Two jack locating members are mounted on the foundation structure, each of which defines a respective socket sized and positioned to interlock with respective ones of the two jacks included in the substructure. In addition, two manually operated jack screws are mounted on the foundation structure in alignment with the sockets on the rear legs of the substructure. Once the jacks have been engaged in the sockets of the ramp, the jack screws can be raised in order to provide support for the rear legs of the substructure. The preferred embodiment includes a cylinder attachment structure in the ramp which is used to mount the lower end of a transfer arm hydraulic cylinder to the ramp.

17 Claims, 7 Drawing Figures

70
74
64
75
22
20
12
16
18
15
34
38
36
100
32
40

DRILLING RAMP

BACKGROUND OF THE INVENTION

This invention is directed to an improved drilling ramp for a mobile drilling rig of the type having a wheeled vehicle which is used to transport and support a drilling mast.

Mobile drilling rigs provide the important advantage of portability. They can be driven or towed to the drilling site, and then erected in a short time in order to begin drilling operations. On occasion, drilling ramps have been used to provide a solid supporting surface for a drilling rig during drilling operations. Such ramps are generally flat, rigid structures which serve to support the wheeled vehicle, including the mast mounted thereon.

It is an object of the present invention to provide an improved drilling ramp which provides stable and secure support for a drilling rig positioned thereon, which enables the drilling rig to be manufactured so as to maintain adequate road clearances, which includes means for simply and repeatedly positioning the drilling rig at a predetermined position on the ramp, and which provides direct and simple means for securing the lower end of a hydraulic cylinder, which cylinder is used to raise and lower a transfer arm mounted on the drilling rig.

SUMMARY OF THE INVENTION

According to this invention, a drilling ramp is provided for a mobile drilling rig of the type having a wheeled vehicle and a mast substructure mounted on the vehicle, wherein the substructure includes four legs, two of which serve to mount respective power jacks, and two of which serve to mount respective leg locating members. The ramp of this invention includes a substantially planar foundation adapted to support the drilling rig. Guide means are mounted on the foundation for guiding the wheeled vehicle to a selected position and orientation on the foundation. Two jack locating members are mounted to the foundation in predetermined positions, such that when the wheeled vehicle is placed in the selected position on the foundation, each of the jack locating members is situated under a respective one of the two jacks to locate and hold the respective jack in position with respect to the foundation. In addition, two adjustable support structures are provided, each mounted to the foundation in a respective predetermined position, such that when the wheeled vehicle is placed in the selected position on the foundation, each of the support structures is situated under a respective one of the two leg locating members to locate and hold the respective leg in position with respect to the foundation.

In the preferred embodiment described below, each of the jack locating members defines a socket sized and positioned to mate and interlock with a respective ball formed on the lowermost surfaces of the jacks. Furthermore, in this preferred embodiment each of the adjustable support structures comprises a respective jack screw. This embodiment also includes a centrally located pin for holding and retaining the lower end of a hydraulic cylinder used to position a transfer arm included in the drilling rig.

The invention itself, together with further objects and attendant advantages, will best be understood by reference to the following detailed description taken in connection with the accompanying drawings.

DETAILED DESCRIPTION OF THE PRESENTLY PREFERRED EMBODIMENTS

Figure 1:
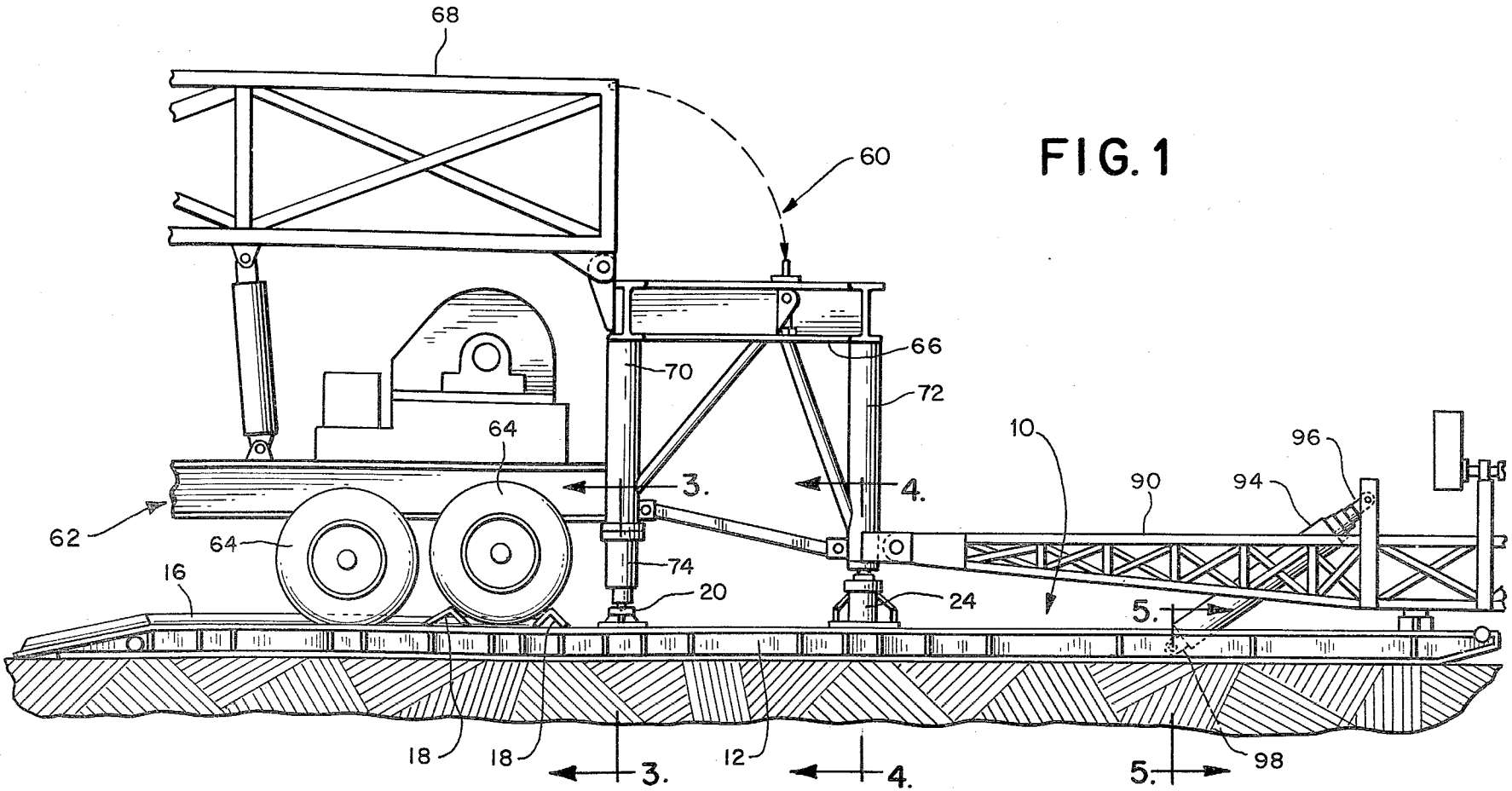
FIG. 1 is a side elevational view of a preferred embodiment of the ramp of this invention showing a drilling rig in place on the ramp.
Figure 2:
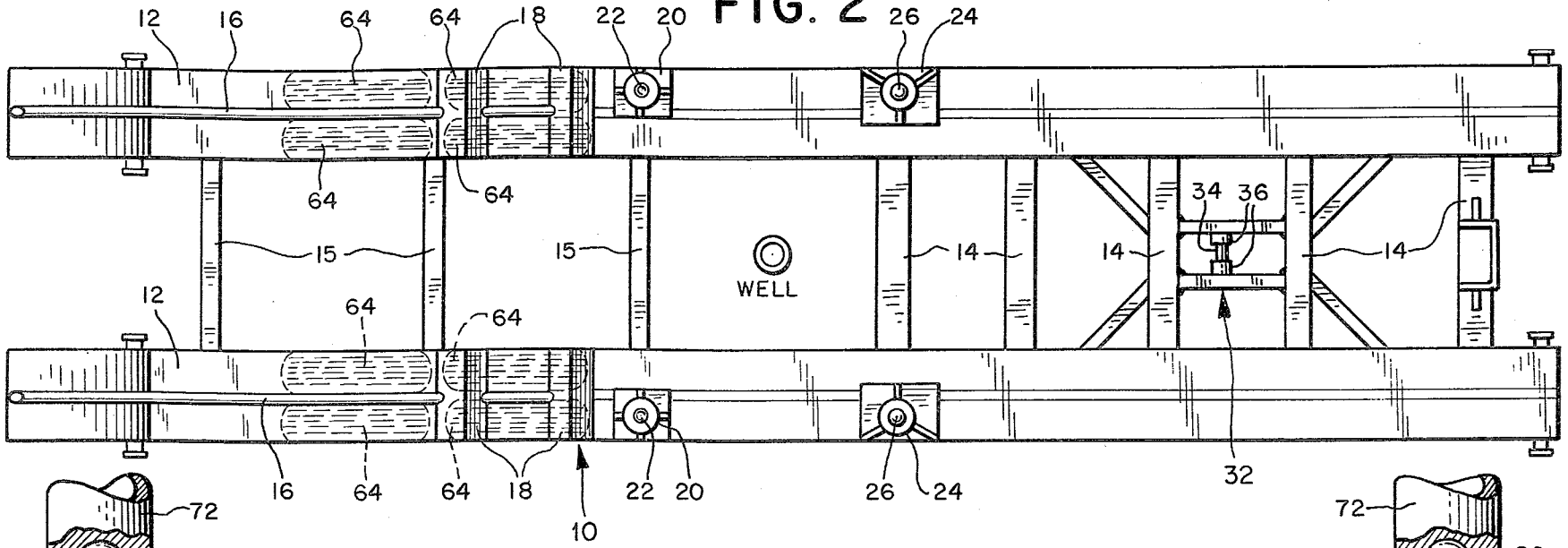
FIG. 2 is a plan view of the ramp of FIG. 1.

Turning now to the drawings, FIGS. 1 and 2 show side and plan views of a ramp 10 which comprises a first preferred embodiment of this invention. As shown in FIG. 1, a drilling rig 60 is supported by the ramp 10.

The ramp 10 is a substantially planar, rigid structure made up of two spaced, parallel longitudinal members 12 which are interconnected by a plurality of cross members 14,15. Heavy, I-beam construction is used in order to provide the ramp 10 with adequate rigidity in order to support the drilling rig 60 securely during the drilling operation.

As shown in FIGS. 1 and 2, the ramp 10 includes two spaced, parallel longitudinal guide bars 16, each of which is centered on a respective longitudinal member 12 of the ramp 10. In addition, two chocks 18 are positioned on each of the longitudinal members 12 transversely to the longitudinal guide bars 16. As will be explained in detail below, the longitudinal guide bars 16 define a longitudinal direction on the ramp 10, and the transverse chocks 18 define a predetermined position along the length of the guide bars 16. In this preferred embodiment, both the guide bars 16 and the chocks 18 are securely welded in place on the ramp 10 so as to define precisely their position relative to the ramp 10.

The ramp 10 also includes two spaced jack locating members 20, one of which is positioned on each of the two longitudinal members 12 adjacent the chocks 18. Each of these locating members 20 is welded in place on the ramp 10, and is precisely positioned with respect to the chocks 18. Each of the jack locating members 20 defines a respective socket 22, as shown in detail in FIG. 3.

Figure 4:
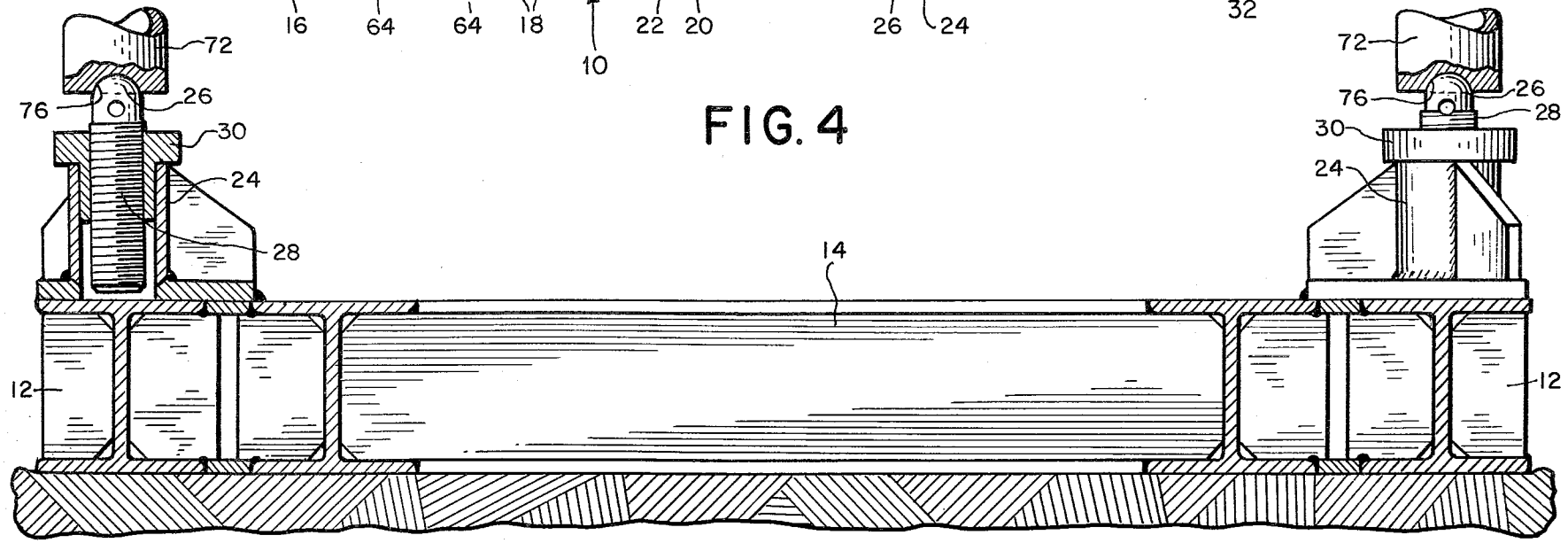
FIG. 4 is a sectional view taken along line 4–4 of FIG. 1.

Also included in the ramp 10 are two leg support structures. In this preferred embodiment, each of these support structures includes a respective jack screw 24. As shown in FIG. 4, each of the jack screws 24 comprises a threaded shaft 28 which is threadedly engaged in a collar 30. Each of the collars 30 is securely welded in place on the ramp 10. Each of the threaded shafts 28 defines a ball 26 at its upper end. By rotating the threaded shafts 28 in the collars 30, the balls 26 can be raised or lowered independently.

Figures 3, 5:
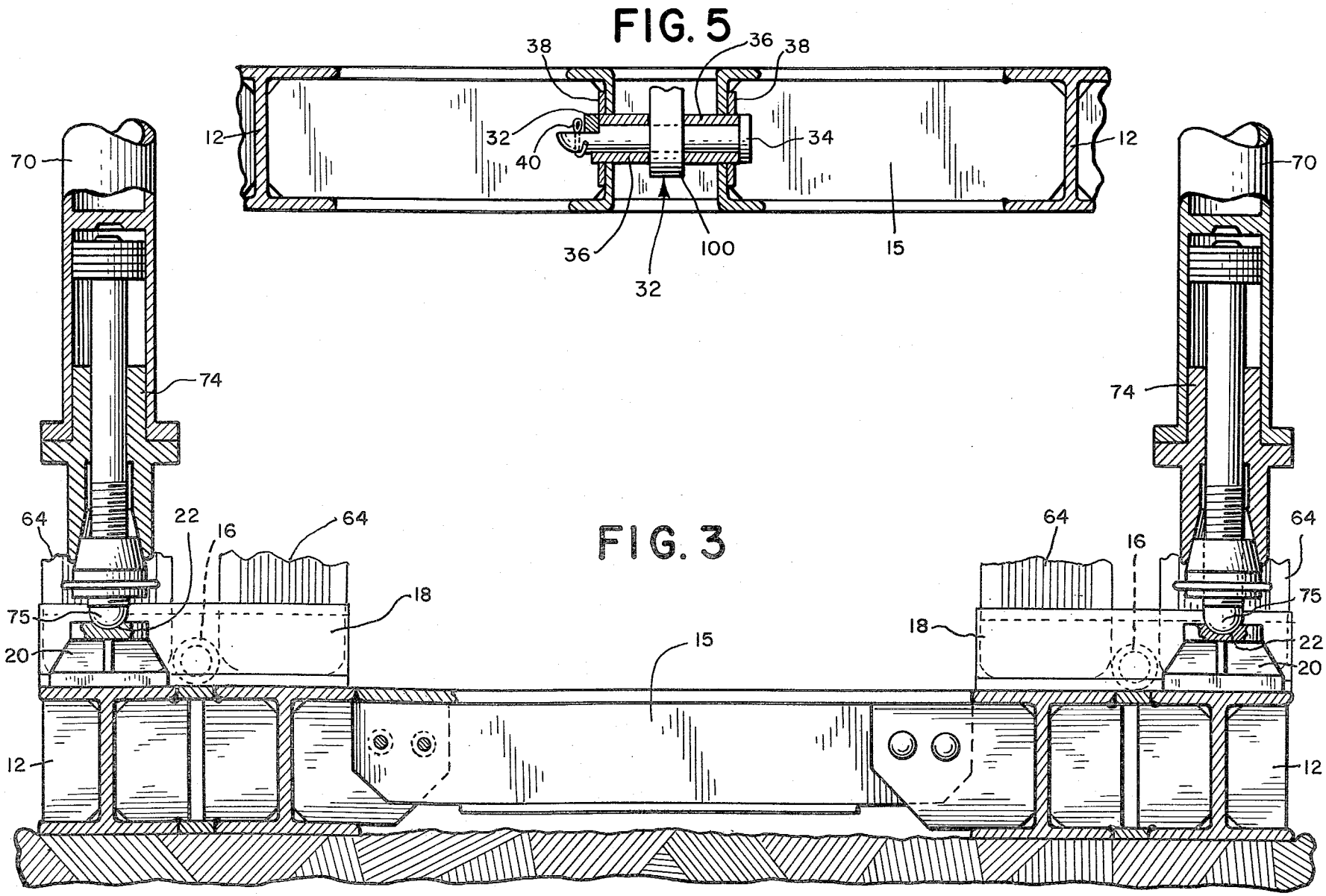
FIG. 3 is a sectional view taken along line 3—3 of FIG. 1.
FIG. 5 is a sectional view taken along line 5—5 of FIG. 1.

FIG. 5 shows a sectional view of a cylinder attachment structure 32 included in the ramp 10. This attachment structure 32 comprises a pin 34 which is held in position in coaxial bearings 36. These bearings 36 are securely held in place by flanges 38 included in the ramp 10. The pin 34 is provided with a flat front end which engages a fixed locking bar 42 on the ramp 10 which serves to prevent the pin 34 from rotating in the bearings 36. In addition, a cotter pin 40 is used in cooperation with a locking bar 42 to capture the pin 34 in the bearings 36.

As will be explained below, the locating members 20, the jack screws 24, and the cylinder attachment structure 32 are preferably positioned precisely with respect to mating components on the drilling rig 60. In many applications, it may be preferable to build a ramp 10 for each drilling rig 60, welding the locating members 20 and the jack screws 24 in position precisely as needed for each individual drilling rig 60.

As shown in FIGS. 1 and 2, the drilling rig 60 comprises a wheeled vehicle 62 which in alternate embodiments can be a motorized carrier or alternatively a trailer. In either case, the wheeled vehicle 62 comprises a plurality of wheels 64 near the rear end thereof. As shown in FIG. 1, the vehicle 62 serves to mount a substructure 66. The substructure 66 serves as a support for a mast 68 which, during drilling operations, rises vertically above the substructure 66. The substructure 66 includes four vertical legs: two front legs 70 situated adjacent the rear end of the vehicle 62, and two rear legs 72 situated remotely from the wheeled vehicle 62. A respective power actuated, hydraulic jack 74 is positioned to extend from a lowermost end of each of the front legs 70, and each of the rear legs 72 defines at its lowermost end a respective socket 76. Each of the jacks 74 defines a convex surface 75 at its lowermost end, sized to interlock and mate with the respective socket 22. In addition, each of the sockets 76 is sized to interlock and mate with the ball 26 of the respective jack screw 24. As will be explained below, the jacks 74 and the sockets 76 cooperate with the mating structure on the ramp 10 in order to level and support the substructure 66.

The drilling rig 60 also includes a transfer arm 90 which is pivotably mounted to the rear legs 72 of the structure 66. The transfer arm 90 is positioned by means of a telescoping hydraulic cylinder 94 which defines an upper end 96 and a lower end 98. This hydraulic cyinder 94 is used to move the transfer arm 90 between a lower position (as shown in FIG. 1) and an upper position (not shown) in which the transfer arm 90 extends parallel to the upright mast 68. The transfer arm 90 is used to move drilling tubulars, such as drill pipe, casing and the like, between a horizontal position at ground level and a vertical position in alignment with the center line of the well. The lower end 98 of the cylinder 94 defines a lug 100 sized to receive the pin 34 of the cylinder attachment structure 32 included in the ramp 10.

Figure 7:
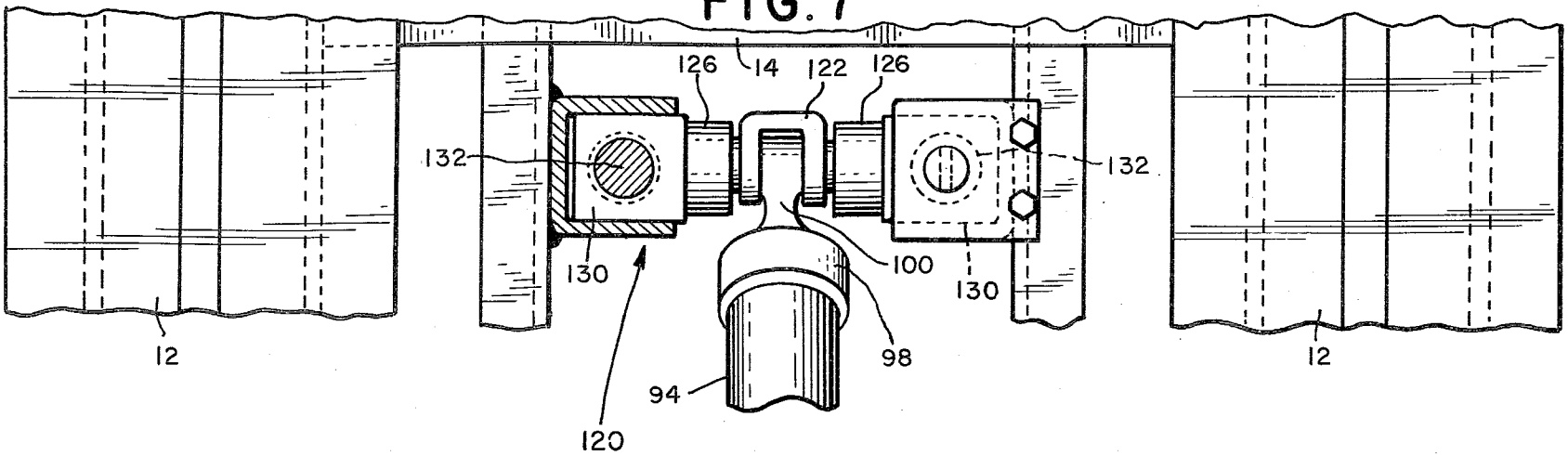
FIG. 7 is a sectional view taken along line 7—7 of FIG. 6.
Figure 6:
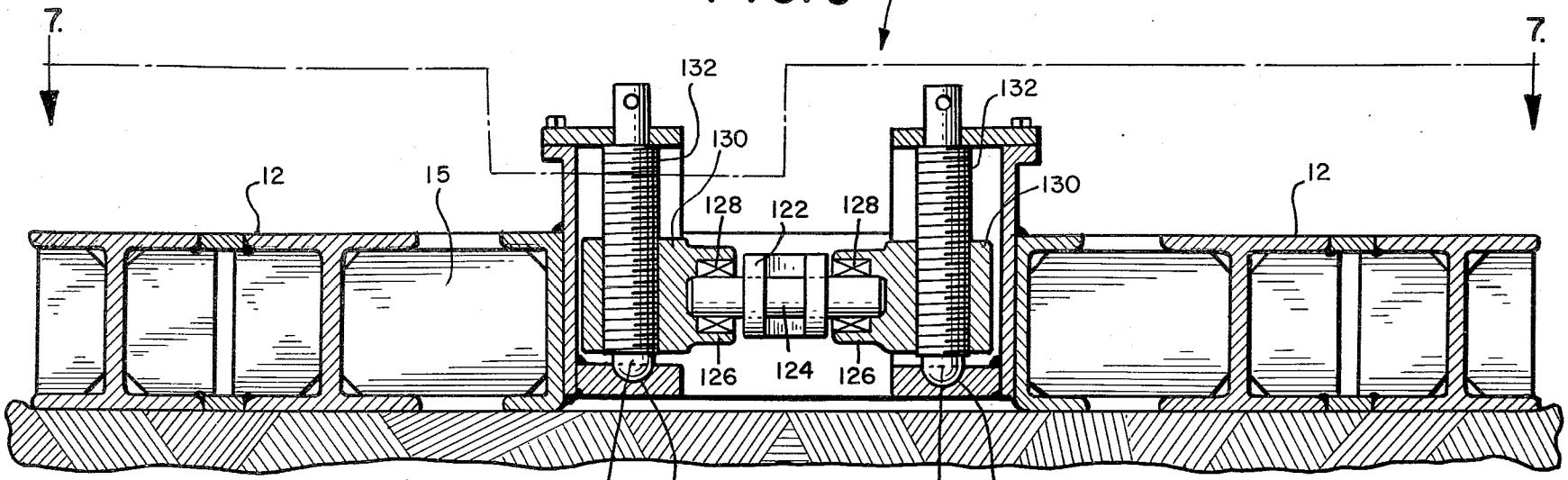
FIG. 6 is a sectional view taken in a plane corresponding to that of FIG. 5 showing a second preferred embodiment of the cylinder attachment structure of this invention.

FIGS. 6 and 7 show an alternative cylinder attachment structure 120 which can be used instead of the structure 32 shown in FIG. 5. The structure 120 includes a central block 122 sized to receive a pin 124. The pin 124 serves to mount the jug 100 of the lowermost end 98 of the cylinder 94 in much the same manner as does the pin 34 of the first preferred embodiment. The block 122 defines two opposed, coaxial shafts 126, each of which is mounted in a respective spherical bearing 128. Each of the spherical bearings 128 is in turn mounted in a respective traveling nut 130 which is threadedly engaged with a respective jack screw 132. Each of the jack screws 132 defines a lowermost end 134 which fits within a respective socket 136 defined by the ramp 10. The jack screws 132 are oriented vertically, and by rotating the jack screws 132, the traveling nuts 130 can be positioned as desired. In this way, the pin 124 can be raised, lower, or tilted as necessary to position the cylinder 94 as desired in order to obtain proper movement of the transfer arm 90. The cylinder attachment structure 120 provides the important advantages of great strength and rigidity in combination with easy adjustability.

Of course, the dimensions and materials used in building the ramp 10 will vary depending on the application. However, the following exemplary specifications are suitable for some applications. These specifications are provided merely to illustrate one presently preferred embodiment, and not by way of limitation.

In the illustrated embodiments, each of the longitudinal members 12 is about 39½ feet long and is built up of two parallel I-beams of A-36 steel, each having a weight of 49 pounds/foot, joined together by ½ inch plate gussets. Each of the cross members 14 is made of a similar I-beam having a length of about 58 inches. The cross members 15 are made of smaller I-beams, and are removably mounted to the longitudinal members 12 by means of bolts. These cross members 15 can be removed when necessary to drag the ramp 10 away from a well. The guide bars 16 are preferably formed of 4 inch pipe and the chocks 18 of angle iron. The jack screws 24 of this embodiment comprise shafts 28 which are five inches in diameter.

Having described the structure of the presently preferred embodiments, the operation of these embodiments can now be discussed. In use, the drilling rig is driven onto the ramp 10 such that the wheels 64 are guided by the longitudinal guide bars 16 in order to orient the drilling rig 60 parallel to the longitudinal axis of the ramp 10. The wheeled vehicle 62 is moved along the ramp 10 in the direction of the longitudinal guide bars until the rearmost wheels 64 are centered between the transverse chocks 18. Preferably, the chocks 18 are high enough such that the wheels 64 do not touch the longitudinal members 12 when centered between the chocks 18. In this way, precise positioning of the wheeled vehicle 62 on the ramp 10 is made possible.

Once the rearmost wheels 64 have been centered within the tranverse chocks 18, the hydraulic jacks 74 are lowered under power until the convex, lowermost portions 75 of the jacks 74 contact the respective jack locating members 20. When this happens, the convex surfaces 75 of the jacks 74 automatically center within the respective sockets 22, thereby precisely positioning the two front legs 70 of the substructure 66. The jacks 74 are then used to level the substructure 66 in the conventional manner.

Once the substructure 66 has been leveled, the jack screws 24 are then manually raised by rotating the threaded shafts 28 in the respective collars 30 until the balls 26 contact the respective sockets 76. The balls 26 are sized to interlock with the respective sockets 76 such that the jack screws 24 serve precisely to position, center, and support the rear legs 72 with respect to the ramp 10. Because only manual power is used in raising the jack screws 24, there is no danger that excessive force may be applied so as to stress or distort the substructure 66. Once the jacks 74 and the jack screws 24 have been properly positioned, the substructure 66 is securely and accurately supported at each of its four legs 70,72 on the ramp 10.

In order to complete the setup of the drilling rig 60 on the ramp 10, the lower end 98 of the cylinder 94 is secured to the ramp 10 with the pin 34. Once mounted, the cylinder 94 serves to position the transfer arm 90 by reacting against the ramp 10. When the embodiment of FIG. 6 is used to attach the cylinder 94 to the ramp 10, the two jack screws 132 can be used to raise, lower, and adjust the tilt angle of the pin 124 in order to orient the cylinder 94 as desired.

The ramp of this invention provides a number of important advantages. First, it provides an excellent foundation for the drilling rig, and eliminates the need for adjustments to compensate for uneven ground surfaces or the sinking of ground surfaces during drilling operations. It provides firm, even support for the substructure 66 throughout the drilling operation.

Second, the ramp of this invention reduces structural loads on the drilling rig because the transfer arm cylinder does not push off of the rig itself. Rather, the cylinder extends between the ramp and the transfer arm, thereby simplifying the linkage used to position the lower end of the transfer arm cylinder while reducing shocks or loads on the rig. The illustrated design provides the further advantage that it uses only a single cylinder rather than twin cylinders to raise and lower the transfer arm. This single cylinder design eliminates the need to synchronize the relative movements of two or more cylinders, and therefore reduces the tendency of the transfer arm to be twisted when used.

Another advantage of this invention is that, because the jack screws 24 are mounted on the ramp 10 rather than on the substructure 66, the road clearance of the substructure 66 is enhanced. Thus, the ramp of this invention allows the drilling rig to be designed so as to be transported more easily, with less concern about road clearances.

Another important advantage is that the sequential positioning approach of this invention allows precise positioning of the drilling rig on the ramp. This sequential approach utilizes first the transverse chocks and the longitudinal guide bars 18,16 to position the wheeled vehicle 62 on the ramp 10, and then the jacks 74 and the sockets 22 to more precisely position the wheeled vehicle 62 on the ramp 10 by means of a metal to metal self-centering interlock between the jacks 74 and the sockets 22. Thus, the guide bars 16 and the chocks 18 only need center the wheeled vehicle 62 within a few inches of the desired final position. Then, the convex surfaces 75 on the jacks 74 automatically center themselves on the sockets 22 in order to complete alignment of the wheeled vehicle 62 on the ramp 10.

Another important advantage of this invention is that the ramp 10 can be transported on a standard flat bed truck, and it can actually serve as a pallet to facilitate transportation of the transfer arm 90. When so used, the transfer arm 90 is centered on the ramp 10 and secured in place such that by securing the ramp 10 to a flat bed truck, the transfer arm is secured in place as well.

Of course, it should be understood that various changes and modifications to the preferred embodiments described above will be apparent to those skilled in the art. Details of construction and geometry can be modified as necessary to fit individual applications. Furthermore, certain embodiments of the ramp of this invention can be used with drilling rigs which do not include a transfer arm. In this case, there is of course no need for a cylinder attachment structure such as the structures 32 or 120. It is therefore intended that foregoing detailed description be regarded as illustrative of the presently preferred embodiments and not as limiting. It is the following claims, including all equivalents, which are intended to define the scope of this invention.

We claim:

1. A drilling ramp for a mobile drilling rig of the type having a wheeled vehicle and a mast substructure mounted on the vehicle, wherein said substructure comprises four legs, two of which support respective power jacks, and two of which support respective leg locating members, said ramp comprising:

a foundation structure adapted to support the drilling rig;

guide means, mounted on the foundation structure, for guiding the wheeled vehicle to a selected position and orientation on the foundation structure;

two jack locating members, each mounted to the foundation structure in a respective predetermined position such that, when the wheeled vehicle is in the selected position on the foundation structure, each of the jack locating members is situated under a respective one of the two jacks to locate and hold the respective jack in position with respect to the foundation structure;

two adjustable support structures, each mounted to the foundation structure in a respective predetermined position such that, when the wheeled vehicle is in the selected position on the foundation structure, each of the support structures is situated under a respective one of the two leg locating members to locate and hold the respective leg in position with respect to the foundation structure.

2. The invention of claim 1 wherein each of the power jacks comprises a respective hydraulic jack and each of the adjustable support structures comprises a respective jack screw.

3. The invention of claim 1 wherein each of the jacks defines a respective convex jack support surface at its lowermost end and each of the jack locating members defines a respective mating socket.

4. The invention of claim 1 wherein each of the support structures defines a respective convex leg support surface at its uppermost end and each of the leg locating members defines a respective mating socket.

5. The invention of claim 1 wherein the guide means comprises a longitudinal guide bar mounted on the foundation structure and two chocks mounted to the foundation structure transversely to the guide bar.

6. The invention of claim 1 wherein the four legs are arranged in a rectangle at one end of the wheeled vehicle, wherein the two jacks are mounted on respective legs near the wheeled vehicle, and wherein the two leg locating members are mounted on respective legs remote from the wheeled vehicle.

7. The invention of claim 1 wherein the drilling rig further comprises a transfer arm and a hydraulic cylinder having a lower end and an upper end, wherein the upper end is coupled to the transfer arm to position the arm, and further, wherein the foundation structure further comprises means for mounting the lower end of the cylinder to the foundation structure such that the cylinder reacts against the foundation structure in positioning the transfer arm.

8. The invention of claim 7 wherein the mounting means comprises:

a pivot bar having first and second ends;

means for mounting the lower end of the cylinder to the pivot bar;

a first adjustable positioning device mounted between the first end of the pivot bar and the foundation structure; and a second adjustable positioning device mounted between the second end of the pivot bar and the foundation structure;

said first and second positioning devices cooperating to adjust the height and tilt angle of the pivot bar with respect to the foundation structure.

9. The invention of claim 8 wherein both the first and second adjustable positioning devices comprise respective jack screws.

10. A drilling ramp for a mobile drilling rig of the type having a wheeled vehicle and a mast substructure mounted thereon, said substructure defining two forward legs adjacent the vehicle and two rearward legs remote from the wheels, each of said forward legs comprising a respective hydraulic jack, each of said rearward legs comprising a respective leg locating member, said ramp comprising:

a foundation structure adapted to support the drilling rig;

longitudinal guide means for guiding the movement of the wheeled vehicle along the support structure;

transverse guide means for positioning the wheeled vehicle at a predetermined position along the longitudinal guide means;

two jack support members, each mounted to a respective selected position on the foundation structure such that each of the jack support members is situated directly under a respective one of the jacks when the wheeled vehicle is positioned in the predetermined position on the foundation structure, each of said jack support members configured to engage and interlock with a respective one of the jacks in order to locate the jacks securely and positively on the foundation structure;

two jack screws, each mounted to a respective selected position on the foundation such that each of the jack screws is situated directly under a respective one of the leg locating members when the wheeled vehicle is positioned on the foundation structure, each of said jack screws configured to engage and interlock with a respective one of the leg locating members in order to locate and support the leg locating members securely and positively on the foundation structure.

11. The invention of claim 10 wherein each of the jacks defines a respective convex jack support surface at its lowermost end and each of the jack locating members defines a respective mating socket.

12. The invention of claim 10 wherein each of the jack screws defines a respective convex leg support surface at its uppermost end and each of the leg locating members defines a respective mating socket.

13. The invention of claim 10 wherein the longitudinal guide means comprises two spaced, parallel bars mounted on the foundation structure.

14. The invention of claim 13 wherein the transverse guide means comprises two spaced, parallel chocks mounted on the foundation structure transverse to the bars.

15. The invention of claim 10 wherein the drilling rig further comprises a transfer arm and a hydraulic cylinder having a lower end and an upper end, wherein the upper end is coupled to the transfer arm to position the arm, and further, wherein the foundation structure further comprises means for mounting the lower end of the cylinder to the foundation structure such that the cylinder reacts against the foundation structure in positioning the transfer arm.

16. The invention of claim 15 wherein the mounting means comprises:

a pivot bar having first and second ends;

means for mounting the lower end of the cylinder to the pivot bar;

a first adjustable positioning device mounted between the first end of the pivot bar and the foundation structure; and a second adjustable positioning device mounted between the second end of the pivot bar and the foundation structure;

said first and second positioning devices cooperating to adjust the height and tilt angle of the pivot bar with respect to the foundation structure.

17. The invention of claim 16 wherein both the first and second adjustable positioning devices comprise respective jack screws.

* * * * *